US006050505A

United States Patent [19]

Ou

[11] Patent Number: 6,050,505

[45] Date of Patent: Apr. 18, 2000

[54] SPRAY COVER FOR A SPRAY CAN

[76] Inventor: Ren-Sheng Ou, 4F, No. 62, Sec. 2, Hsing Lung Rd., Taipei, Taiwan

[21] Appl. No.: 09/220,333

[22] Filed: Dec. 24, 1998

[51] Int. Cl.[7] ..... B05B 1/12

[52] U.S. Cl. ..... 239/395; 239/392; 239/397

[58] Field of Search ..... 239/337, 390, 239/391, 392, 395, 397; 222/402.1, 331, 485, 486

[56] References Cited

U.S. PATENT DOCUMENTS

| | | | |
|---|---|---|---|
| 225,721 | 3/1880 | Prouty | 239/392 |
| 3,258,208 | 6/1966 | Greenebaum, II | 239/397 |
| 3,284,007 | 11/1966 | Clapp | 239/392 |
| 3,414,196 | 12/1968 | Legaza et al. | 239/395 X |
| 3,703,994 | 11/1972 | Nigro | 239/397 |
| 3,711,030 | 1/1973 | Jones | 239/397 |
| 3,743,189 | 7/1973 | Macquire-Cooper | 239/397 X |
| 3,795,366 | 3/1974 | McGhie et al. | 239/397 |
| 5,385,303 | 1/1995 | Gosselin et al. | 239/391 X |
| 5,524,798 | 6/1996 | Stern et al. | 222/402.1 |
| 5,655,691 | 8/1997 | Stern et al. | 239/391 X |

*Primary Examiner*—Lesley D. Morris
*Attorney, Agent, or Firm*—Varndell & Varndell, PLLC

[57] ABSTRACT

A spray cover includes a cover covered on a spray can, the cover having a locating block at the periphery and a guide hole extended from the center of the locating block and connected to the output end of the spray can, and an adjustment block coupled to the locating block and moved on the locating block vertically between a first position, where a first spray hole at the adjustment block is connected to the guide hole at the locating block for producing a first spray, and a second position, where a second spray hole at the adjustment block is connected to the guide hole at the locating block for producing a second spray.

7 Claims, 4 Drawing Sheets

SPRAY COVER FOR A SPRAY CAN

BACKGROUND OF THE INVENTION

1. Field of the Invention

The present invention relates to a spray cover for a spray can, and more particularly to such a spray cover that can be adjusted to selectively control the output volume of the spray.

2. Description of the Prior Art

Regular spray cans (insecticide spray cans, cooling agent spray cans, paint spray cans, rust-proof coating spray cans, etc.) are commonly equipped with a fixed spray nozzle for output of a spray. The output volume of these spray cans is not adjustable. There is known a spray can having a spray nozzle attached with a detachable nozzle tube. When the nozzle tube is attached, the output volume of the spray is relatively changed. Because the nozzle tube is detachably attached to the spray nozzle, it tends to be forced out of the spray nozzle accidentally.

SUMMARY OF THE INVENTION

According to one aspect of the present invention, the spray cover comprises a cover covered on a spray can, the cover having a locating block at the periphery and a guide hole extended from the center of the locating block and connected to the output end of the spray can, and an adjustment block coupled to the locating block and moved on the locating block vertically between a lower limit position, where a first spray hole at the adjustment block is connected to the guide hole at the locating block for producing a first spray, and an upper limit position, where a second spray hole at the adjustment block is connected to the guide hole at the locating block for producing a second spray. The first spray hole and the second spray hole have different diameters for a different output volume of the spray. According to another aspect of the present invention, a telescopic nozzle is mounted in the second spray hole to guide the output of the second spray.

DETAILED DESCRIPTION OF THE PREFERRED EMBODIMENT

Figure 1:
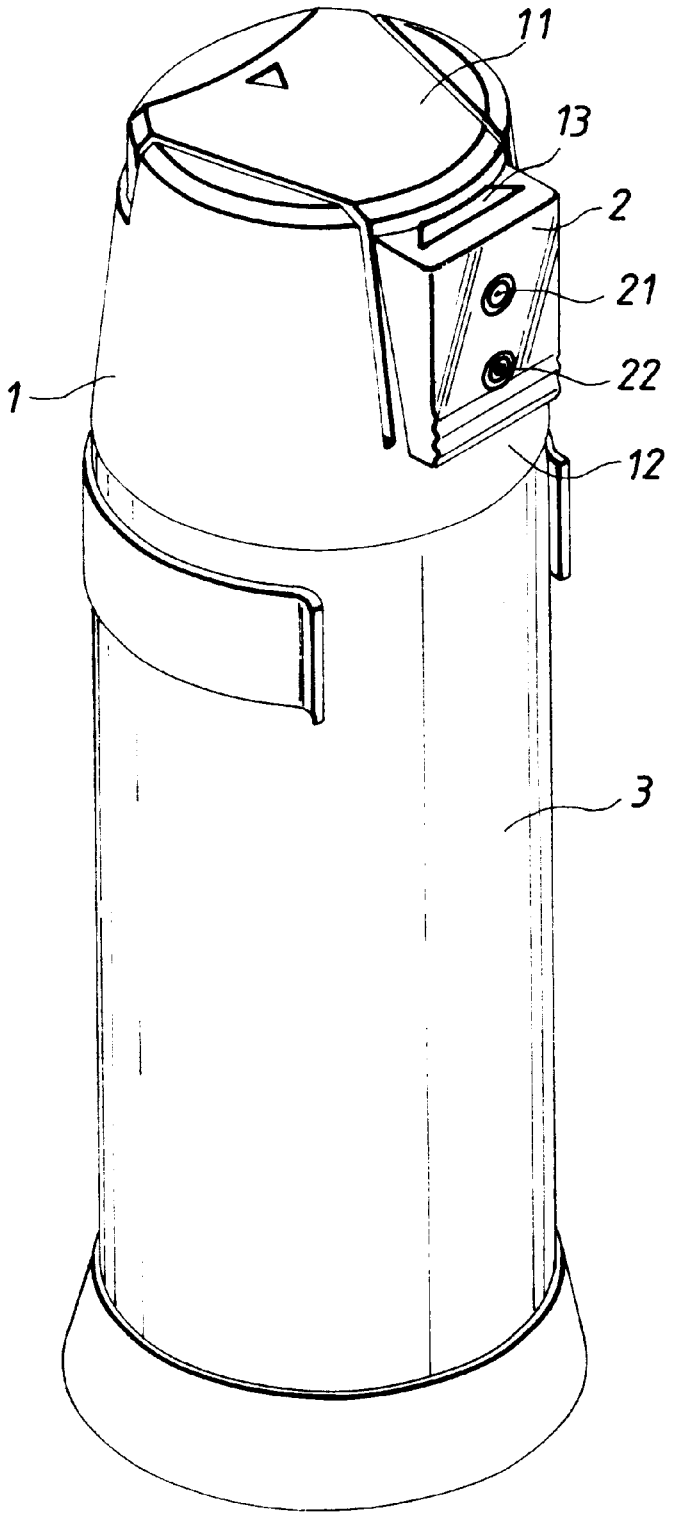
FIG. 1 illustrates a spray cover covered on a spray can according to the present invention.
Figure 2:
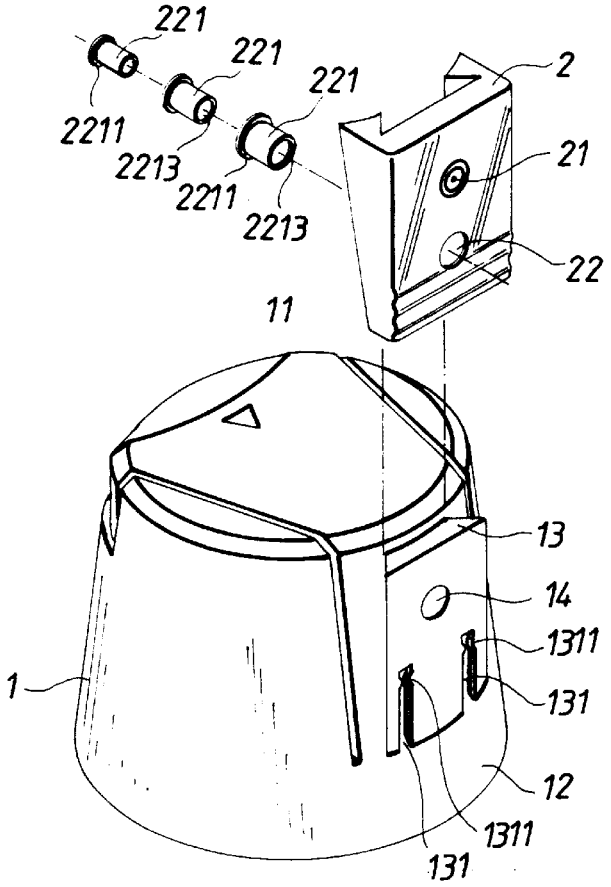
FIG. 2 is an exploded view of the spray cover according to the present invention.
Figure 4:
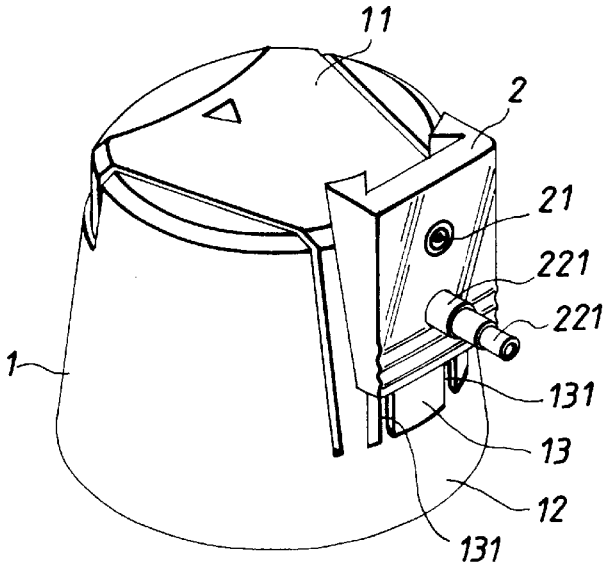
FIG. 4 is a perspective view of the present invention, showing the second spray hole connected to the guide hole.
Figure 3:
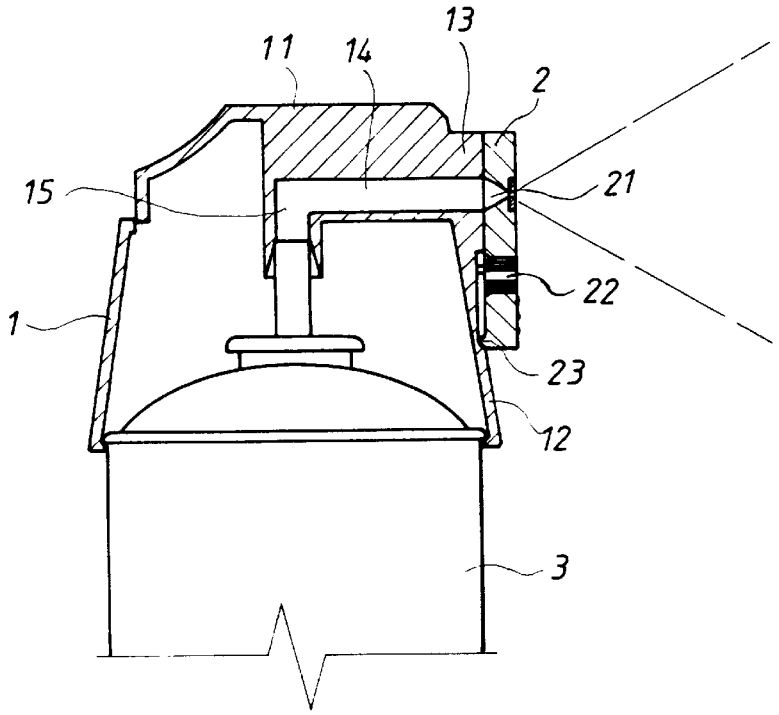
FIG. 3 is a sectional assembly view of the present invention, showing the first spray hole connected to the guide hole.

Referring to FIGS. 1 and 2, a spray cover is shown comprised of a cover 1 covered on a spray can 3, and an adjustment block 2 coupled to the cover 1.

The cover 1 comprises a peripheral wall 12, a suspended top press wall 11 having an angled fixed end integral with the peripheral wall 12 and a free end separated from the peripheral wall 12, a locating block 13 raised from the connecting area between the fixed end of the top press wall 11 and the peripheral wall 12, a guide hole 14 at the center of the locating block 13, and a guide tube 15 extended from the guide hole 14 and connected to the output end of the spray can 3. The adjustment block 2 is axially slidably coupled to the locating block 13 by for example a dovetail joint, having a first spray hole 21 and a second spray hole 22 at different elevations, and a telescopic nozzle mounted in the second spray hole 22 which is comprised of a plurality of nozzle elements 221 sliding one inside another.

Referring to FIGS. from 3 through 5, the adjustment block 2 can be moved on the locating block 13 between a first position where the first spray hole 21 is connected to the guide hole 14, and a second position where the telescopic nozzle of the nozzle elements 221 is connected to the guide hole 14. The first spray hole 21 and the telescopic nozzle of the nozzle elements 221 have different diameters for producing a spray at a different volume. Further, the peripheral wall 12 of the cover slopes downwardly outwards. The locating block 13 comprises two elongated sliding slots 131 arranged in parallel and vertically extended to the bottom edge thereof, and two raised portions 1311 respectively raised from the outside wall thereof at the top ends of the elongated sliding slots 131. The adjustment block 2 comprises two raised portions 23 on the inside wall thereof at the bottom. When the adjustment block 2 is coupled to the locating block 13, the raised portions 23 of the adjustment block 2 are respectively engaged into the elongated sliding slots 131. When the adjustment block 2 is moved upwards along the locating block 13 to the upper limit position, the raised portions 23 of the adjustment block 2 are respectively stopped at the raised portions 1311 at the locating block 13, enabling the second spray hole 22 to be maintained in connection with the guide hole 14.

Figure 5:
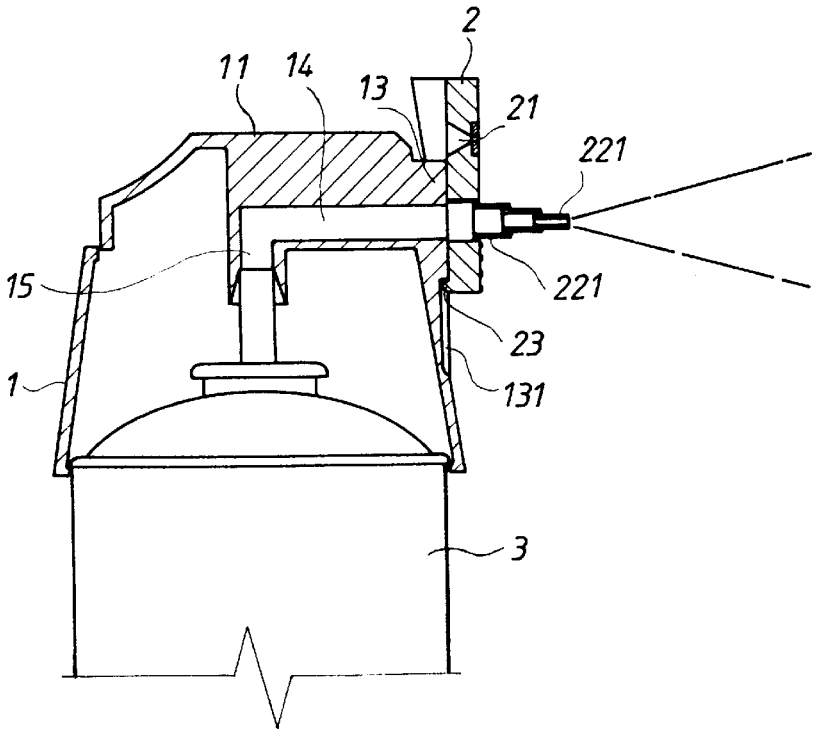
FIG. 5 is a sectional view of FIG. 4.
Figure 6:
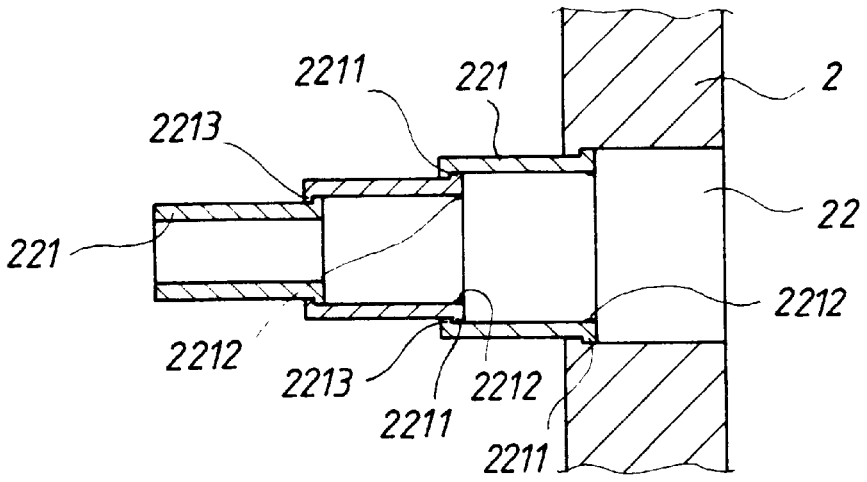
FIG. 6 is a sectional view in an enlarged scale of a part of the present invention, showing the nozzle elements of the telescopic nozzle extended out of one another.

Referring to FIG. 6 and FIG. 5 again, the nozzle elements 221 of the telescopic nozzle each having an outside peripheral flange 2211 and an inside peripheral flange 2212 and at one end, and an inside peripheral flange 2213 at an opposite end. The nozzle elements 221 are arranged one inside another within the second spray hole 22 at the adjustment block 2. When a spray of a liquid is driven out of the guide hole 14, the nozzle elements 221 of the telescopic nozzle are forced to extend out of one another, enabling the outside peripheral flange 2211 of one nozzle element 221 to be stopped at the inside peripheral flange 2213 of another. As an alternative form of the present invention, the nozzle elements 221 can be respectively shaped like a tapered tube so that they engage with one another when extended out of one another.

Figure 7:
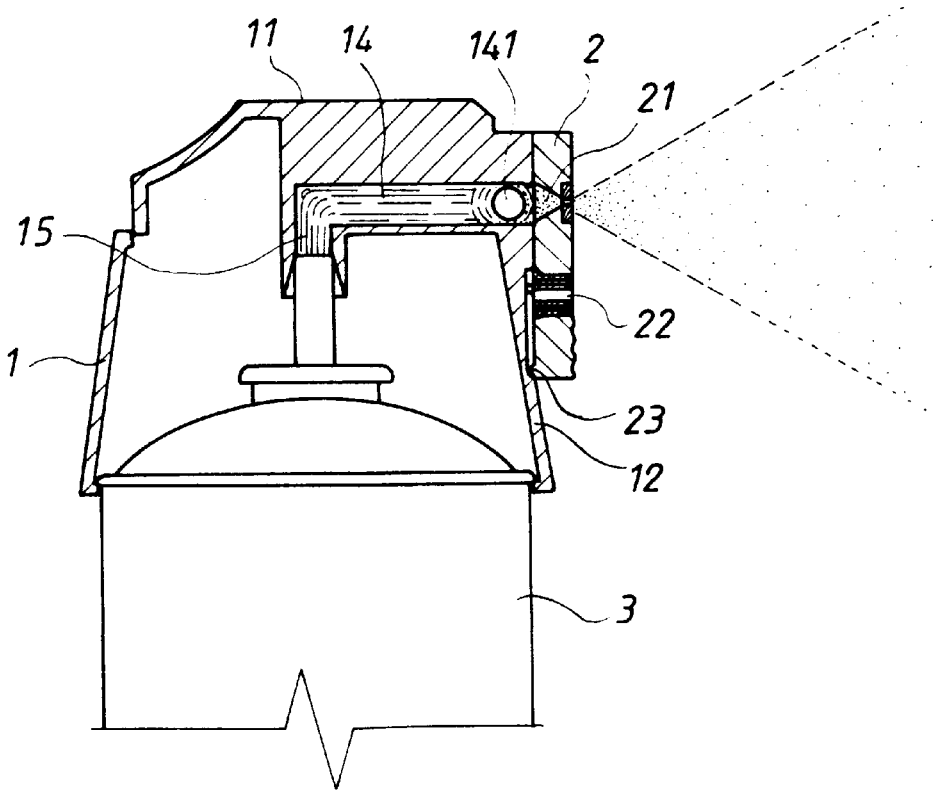
FIG. 7 is similar to FIG. 3 but showing a ball moved in the guide hole.

Referring to FIG. 7, a ball 141 is moved in the guide hole 14 inside the cover 1. When a liquid is driven out of the spray can 3 into the guide hole 14 through the guide tube 15, the rush flow of liquid is forced to pass over the ball 141 out of the spray hole 21 or 22, forming a spray of fine drops of liquid.

It is to be understood that the drawings are designed for purposes of illustration only, and are not intended as a definition of the limits and scope of the invention disclosed.

What the invention claimed is:

1. A spray cover comprising:

a cover seated on a spray can, said cover comprising a peripheral wall, a suspended top press wall having an angled fixed end integral with said peripheral wall and a free end separated from said peripheral wall, a locating block raised from the connecting area between the fixed end of said top press wall and said peripheral wall, a guide hole at the center of said locating block, and a guide tube extended from said guide hole and connected to the output end of the spray can on which said cover is seated; and an adjustment block coupled to said locating block and moved on said locating block vertically between an upper limit position and a lower limit position, said adjustment block comprising an upper spray hole, which is connected to said guide hole when said adjustment block is moved to said lower limit position, and a lower spray hole, which is connected to said guide hole when said adjustment block is moved to said upper limit position.

2. The spray cover of claim 1 wherein the peripheral wall of said cover slopes downwardly outwards.

3. The spray cover of claim 1 wherein said locating block of said cover comprises two elongated sliding slots arranged in parallel for guiding movement of said adjustment block on said locating block, said elongated sliding slots each having a top end and a bottom end extended from the top end to a bottom edge of said locating block, and two raised portions respectively disposed at the top ends of said elongated sliding slots for stopping said adjustment block at said upper limit position.

4. The spray cover of claim 3 wherein said adjustment block comprises two raised portions raised from an inside wall thereof and respectively engaged into the elongated sliding slots at said locating block.

5. The spray cover of claim I further comprising a telescopic nozzle mounted in the lower spray hole at said adjustment block, said telescopic nozzle comprised of a plurality of nozzle elements that slide one inside another.

6. The spray cover of claim 1 wherein said adjustment block is coupled to said locating block by a dovetail joint.

7. The spray cover of claim 1 further comprising a ball moved in the guide hole inside said cover.

* * * * *